United States Patent [19]

Meyer

[11] 4,270,111

[45] May 26, 1981

[54] ELECTRICAL INDUCTIVE APPARATUS

[75] Inventor: Lloyd E. Meyer, Delaware Township, Mercer County, Pa.

[73] Assignee: Westinghouse Electric Corp., Pittsburgh, Pa.

[21] Appl. No.: 124,485

[22] Filed: Feb. 25, 1980

[51] Int. Cl.[3] ..... H01F 15/14

[52] U.S. Cl. ..... 336/70; 336/187

[58] Field of Search ..... 336/69, 70, 186, 187, 336/150, 5, 10, 12

[56] References Cited

U.S. PATENT DOCUMENTS

| | | | |
|---|---|---|---|
| 3,611,229 | 10/1971 | Yannucci | 336/70 |
| 3,781,739 | 12/1973 | Meyer | 336/70 |
| 3,899,764 | 8/1975 | Van Nice | 336/70 |

*Primary Examiner*—Thomas J. Kozma

*Attorney, Agent, or Firm*—D. R. Lackey

[57] ABSTRACT

An interleaved turn, high series capacitance winding for electrical inductive apparatus having four mutually interleaved, electrically conductive paths through a plurality of axially spaced pancake coils. The pancake coils have a like number of total conductor turns, with each electrically conductive path, in each pancake coil, having an average of $N+\frac{1}{2}$ conductor turns.

4 Claims, 3 Drawing Figures

ELECTRICAL INDUCTIVE APPARATUS

BACKGROUND OF THE INVENTION

1. Field of the Invention

The invention relates in general to electrical inductive apparatus, such as power transformers, and more specifically to electrical windings for such apparatus which have a high series capacitance.

2. Description of the Prior Art

Electrical inductive apparatus, such as single and polyphase electrical power transformers of the core-form type, commonly utilize a high voltage phase winding which includes a plurality of electrically connected pancake- or disc-type coils arranged in an axially aligned stack about a winding leg of a magnetic core. A surge potential, such as caused by lightning or switching, applied to the line terminal of a winding of this type, distributes itself across the turns of the pancake coils, across the winding, and from the winding to ground according to the capacitive structure of the winding, with the conductors and ground being the "electrodes" of the capacitors, and the winding insulation, and other insulating members, providing the dielectric. It is characteristic of the pancake coil type winding for a surge potential to concentrate at the line end of the winding, and rapidly attenuate as it enters the winding. It is desirable to distribute such surges as uniformly as possible across the turns of the pancake coils, and across the pancake coils of the winding, in order to prevent the stress from building up to undesirably high values, which may cause the stressed insulation to fail. Further, it is desirable to uniformly distribute surge potentials in order to reduce the magnitude of transient voltage oscillations produced when the voltage distribution changes from capacitive to inductive. The more nearly the capacitive voltage distribution conforms to the inductive distribution, the lower the magnitude of transient voltage oscillations produced as the distribution changes from capacitive to inductive.

An indication of how uniformly a surge potential will be distributed across a winding may be obtained from the distribution constant alpha of the winding. The distribution constant alpha is equal to the square root of the ratio of the capacitance $C_g$ of the winding to ground to the through or series capacitance $C_s$ of the winding.

$$\left(\alpha = \sqrt{\frac{C_g}{C_s}}\right)$$

The smaller the distribution constant alpha, the more uniformly a surge voltage will be distributed across the winding. Since the distribution constant alpha may be reduced by increasing the series capacitance of the winding, it is common in the prior art to form the pancake coils by simultaneously winding two or more conductors to form a plurality of coil sections, the turns of which are radially interleaved. Then, by connecting the sections of the pancake coils to mechanically locate turns from an electrically distant part of the coil or winding, between electrically connected turns, called interleaving, the voltage between physically adjacent coils is increased and adjacent turns are effectively connected in parallel, which increases the through or series capacitance of each pancake coil, and of the electrical winding.

Many different interleaving arrangements are used in the prior art. Certain of the arrangements are necessary in order to achieve different degrees of interleaving, and thus different values of series capacitance as required by specific applications, or in different sections of a single winding. Other arrangements are necessary in order to achieve interleaved type windings while utilizing two or more electrical conductors which are connected in parallel with one another, in order to increase the current carrying capacity of the winding.

The desired current carrying capacity and loss rating of the electrical inductive apparatus determine the conductor cross-sectional area for the winding turns, and the number of parallel-connected strands to achieve this cross-sectional area. Transformer losses are becoming of greater importance to electrical utilities, and thus transformers are being designed to achieve lower losses. The cross-sectional area of the conductive portion of a conductor turn is increased in order to reduce $I^2R$ losses. The required cross-sectional area is provided by a plurality of strands, instead of being provided in one large conductor, in order to reduce losses due to eddy currents. Thus, the windings for a given power rating are increasing in physical size. Increasing the physical size of a winding greatly increases the manufacturing cost of such apparatus, beyond the extra cost of the added conductor material, because it increases the size of the associated magnetic core, which, in turn, requires a larger tank, and the larger tank requires more liquid dielectric. When the winding whose physical size is increased is an inner winding of concentrically adjacent windings, the manufacturing cost escalation is particularly steep, with even very small increases in the diameter of an inner winding resulting in large increases in manufacturing cost, as the outer windings then must have larger inside diameters, greatly increasing their outside dimensions, with the associated increases in the size of the magnetic core and tank.

Thus, when the transformer is designed for the required impedance, current carrying capacity, and losses, using the list of discrete wire sizes available, it may require that each coil section have an average predetermined number of conductor turns, plus a half conductor turn, in order to provide the required volts per turn over a predetermined number of pancake coils having a predetermined axial stack dimension and predetermined radial build dimension.

Certain high BIL-rated inner windings must have a high series capacitance in order to prevent surge concentrations, as hereinbefore set forth. The current carrying capacity and loss rating may require that this high series capacitance inner winding have four strands or four parallel-connected conductive paths. If the design then dictates a half turn, it would be extremely difficult to economically construct such as winding using prior art techniques, and obtain a mechanically strong structure having a uniform, minimum build dimension.

SUMMARY OF THE INVENTION

Briefly, the present invention is an interleaved turn, high series capacitance winding for electrical inductive apparatus, such as power transformers, which may be used as an inner winding, or an outer winding, in concentrically adjacent core-form construction. The winding includes four mutually interleaved electrically conductive paths which extend through a plurality of axially spaced pancake coils. The basic interleaving pattern is completed over a pair of immediately adjacent pancake coils, with such a pair being termed a "basic pair", and then this basic pattern is repeated from basic pair to basic pair across the winding.

Each of the four electrical paths has N conductor turns in one coil of a basic pair and N+1 turns in the other, balanced such that the pancake coils all have a like number of total conductor turns. This arrangement provides a uniform build dimension from coil to coil, while achieving an average of $N+\frac{1}{2}$ turns per electrical path, per pancake coil.

BRIEF DESCRIPTION OF THE DRAWINGS

Further advantages and uses of the invention will become more apparent when considered in view of the following detailed description of exemplary embodiments thereof, taken with the accompanying drawings, in which.

DESCRIPTION OF PREFERRED EMBODIMENT

Figure 1:
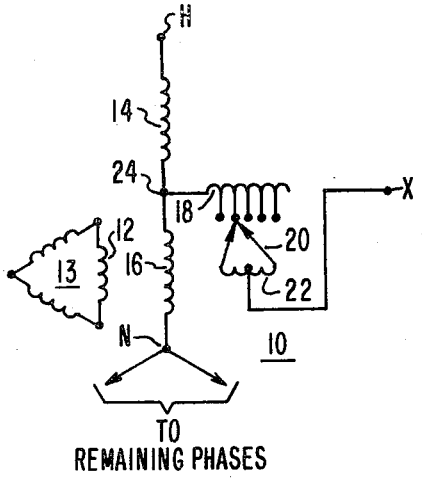
FIG. 1 PRIOR ART
FIG. 1 is a schematic diagram of electrical inductive apparatus, which may advantageously utilize the teachings of the invention.
Figure 2:
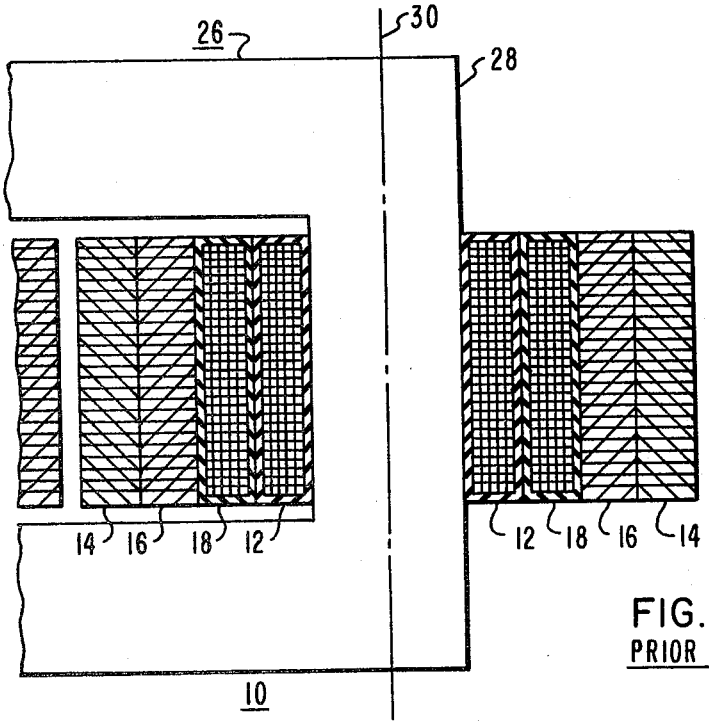
FIG. 2 PRIOR ART
FIG. 2 is a fragmentary, elevational view, illustrating how the electrical windings shown in FIG. 1 would be disposed relative to one another on the leg of a magnetic core.

Referring now to the drawings, and to FIGS. 1 and 2 in particular, there are shown schematic and fragmentary cross-sectional elevational views, respectively, of electrical inductive apparatus 10 which may utilize the teachings of the invention. The invention is particularly advantageous when applied to an inner winding, because it facilitates the construction of a mechanically strong, high series capacitance multistrand winding having minimum dimensions. Thus, the electrical inductive apparatus 10 is illustrated as an autotransformer, in order to illustrate where such a high series capacitance inner winding may be used. However, it is to be understood that the invention applies equally to inner and outer windings, whether of the autotransformer or isolated winding type.

More specifically, electrical inductive apparatus 10 is a three-phase autotransformer of the core-form type, with only one of the three phases being illustrated, as the other two would be similar. Apparatus 10 includes an auxiliary winding 12, which may be connected to the auxiliary windings of the remaining two phases, as illustrated, in order to provide a delta or tertiary winding 13. Each phase additionally includes first and second windings 14 and 16 connected at junction 24 to provide a series circuit from a high voltage terminal H to a neutral terminal N via windings 14 and 16, respectively. A regulating winding 18, along with conventional regulator apparatus such as a tap changer 20 and a preventive auto 22, are connected between junction 24 and a lower voltage terminal X.

FIG. 2 is a fragmentary elevational view, in section, of one phase of electrical inductive apparatus 10, which illustrates a typical placement of the various windings shown schematically in FIG. 1. Apparatus 10 includes a magnetic core 26 having a winding leg portion 28. Winding leg 28 includes a vertically oriented, longitudinal axis 30, about which the various phase winding assemblies are concentrically and adjacently disposed. For example, the auxiliary winding 12 may be disposed immediately adjacent to the magnetic core leg 28, the regulating winding 18 may be the next outermost winding, followed by windings 16 and 14. Windings 14 and 16 may both be constructed according to the teachings of the invention. It will be readily apparent from observing FIG. 2 why it is of the utmost importance to minimize the dimensions of any electrical winding, and especially the radial dimension of an inner winding, because of the way it adversely affects the dimensions of any outer windings, the magnetic core, and the surrounding tank or enclosure.

Figure 3:
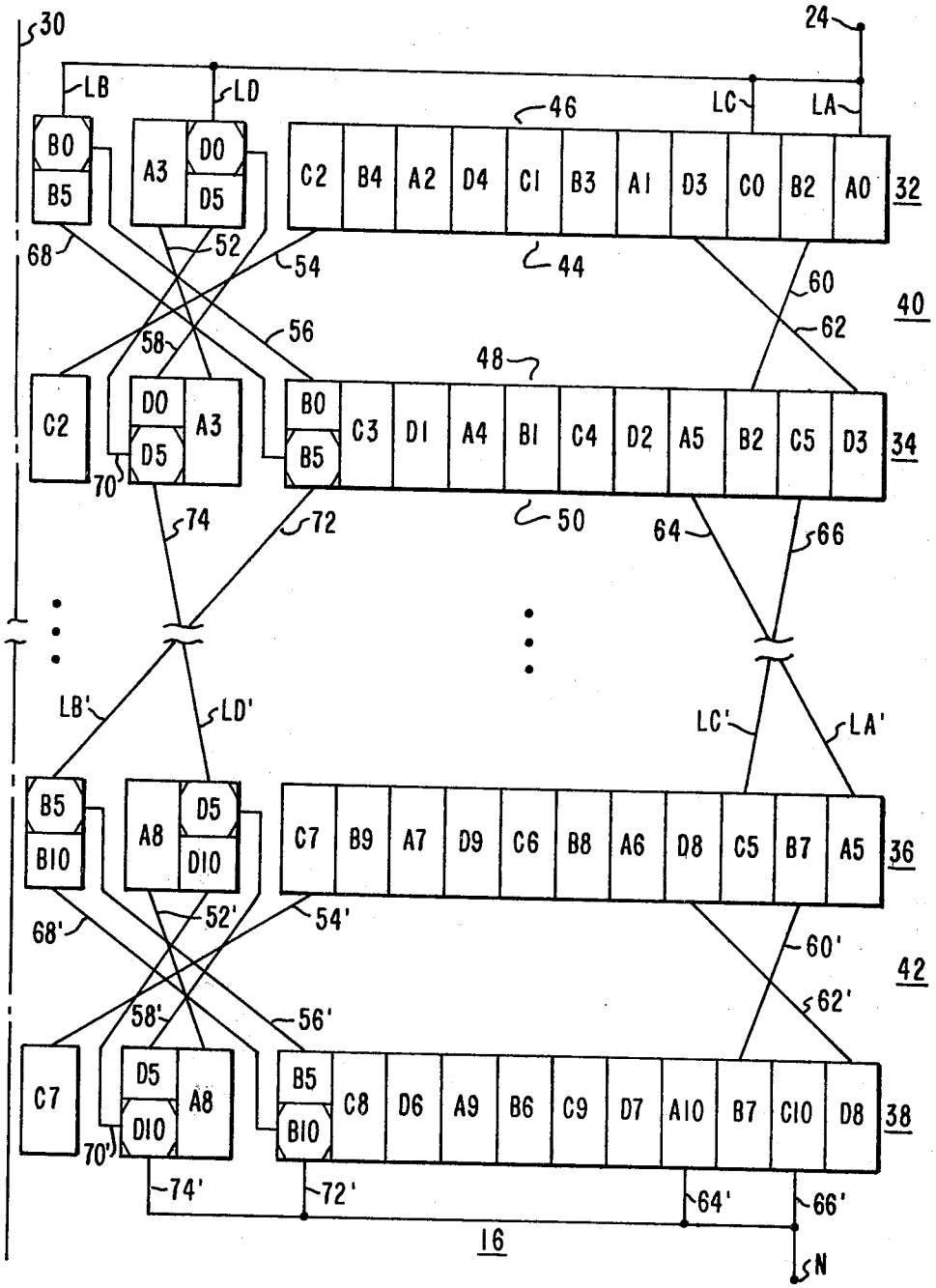
FIG. 3 is a schematic illustration of a four-strand, mutually twin interleaved winding constructed according to the teachings of the invention, which may be used for certain of the windings shown in FIGS. 1 and 2.

FIG. 3 is a schematic representation of a high series capacitance, four-strand, mutually twin interleaved winding constructed according to the teachings of the invention. For purposes of example, it will be assumed that the winding shown in FIG. 3 is the winding 16 shown in FIGS. 1 and 2, and that the design dictates a plurality of pancake or disc coils having an average of $N+\frac{1}{2}$ conductor turns per pancake coil.

Only a sufficient number of pancake coils, and conductor turns per pancake coil, are shown in order to adequately illustrate the invention. It will be understood that the windings may have any desired number of pancake coils, and conductor turns per pancake coil. More specifically, winding 16 includes a plurality of pancake coils which are spaced axially apart in a stacked arrangement about the axis 30 of a leg portion 28 of magnetic core 26. Two pancake coils 32 and 34 are shown adjacent to terminal 24, and two pancake coils 36 and 38 are shown adjacent to terminal N. The intervening pancake coils would be constructed and connected in the same manner as the construction and connections to be hereinafter described.

The plurality of pancake coils of winding 16 are constructed to provide a high series capacitance, interleaved turn-type winding having four parallel circuits between terminal 24 at the start of winding 16, and terminal N at the finish of the winding. The pancake coils of winding 16 are connected to form a plurality of basic pairs, each having first and second adjacent pancake coils, with the basic interleaving arrangement being accomplished in each basic pair. Then, the basic pairs are interconnected, in order to provide four parallel circuits between the start and finish ends of the winding. Since two pancake coils are required to complete the basic interleaving pattern, it is commonly referred to as twin interleaving. In FIG. 3, pancake coils 32 and 34 form a basic pair 40, and pancake coils 36 and 38 form a basic pair 42.

Each of the pancake coils have a plurality of conductor turns formed of first, second, third and fourth electrical conductors or strands spirally wound together about the common axis 30 to provide first, second, third and fourth sections in each pancake coil, with each section having inner and outer ends. The turns of the coil sections are radially interleaved with one another in substantially the same plane. The inner ends are termed the "start", and the outer ends the "finish" of a pancake coil section, regardless of where the electrical circuit first enters the associated section. The conductor turns are insulated from one another in a manner well known in the art, with the insulation not being shown in order to clarify the drawings.

Each pancake coil of a basic pair has an adjacent side, and a non-adjacent side, referenced with respect to the other pancake coil of the pair. Thus, pancake coil 32 has an adjacent side 44, and a non-adjacent side 46, and pancake coil 34 has an adjacent side 48, and a non-adjacent side 50.

The four circuits, referenced A, B, C and D, spiral inwardly through the first pancake coil of a basic pair, and outwardly through the second pancake coil, with their turns mutually interleaved. The individual turns of a composite conductor turn appear in the order A, B, C and D, with the A and C circuits first entering the ends of the outermost turns of these circuits in pancake coil 32 via conductors LC and LA. It will be noted that the A, B, C and D circuits spiral inwardly together until reaching the start of the last conductor turn. The last conductor turn is formed using only the A and B strands, with the C and D strands being used to form the first turn of the second pancake coil 34 of the basic pair 40. Thus, the A and B circuits have one more conductor turn in pancake coil 32 than the C and D circuits. In like manner, the C and D circuits have one more conductor turn in pancake coil 34 than the A and B circuits.

The first or innermost conductor turn of pancake coil 34 is formed using only the C and D strands. The A and B strands then join the C and D strands to form the remaining conductor turns, which spiral outwardly in pancake coil 34. Thus, the C and D strands, as hereinbefore stated, have one more conductor turn in the second pancake coil 34 than the A and B strands. Over a basic pair, all four circuits have exactly the same number of conductor turns, and each pancake coil has the same total number of turns as all of the other pancake coils. If each circuit has N turns in one pancake coil, and N+1 turns in the other pancake coil of a basic pair, the average number of turns per pancake coil for each of the four parallel circuits is $N+\frac{1}{2}$, which achieves the objective of being able to provide half-turn capability in a four-strand, mutually twin interleaved high series capacitance winding.

Returning to the description of the four parallel circuits in a basic pair, the ends of the innermost turns of the A and C circuits in pancake coil 32 are connected to the ends of the innermost turns of the A and C circuits in pancake coil 34 via start-start connections 52 and 54, respectively.

The B and D circuits first enter pancake coil 32 from its non-adjacent side 46, but while these circuits are physically within the planes of sides 46 and 44, they do not function electrically as a part of pancake coil 32 at this time. This is due to the fact that both of these circuits leave pancake coil from its adjacent side after progressing in their circumferential locations for only a few inches. The B and D circuits, after this initial physical penetration of pancake coil 32, immediately proceed from the adjacent side of pancake coil 32 and they enter the ends of the innermost turns of the B and D circuits of pancake coil 34 via start-start connections 56 and 58, respectively.

The C and D strands are wound together to form the innermost turn of pancake coil 34, and they are then joined by the A and B strands to complete the remaining turns. The ends of the outermost B and D conductor turns of pancake coil 34 are connected to the ends of the outermost turns of the B and D circuits in pancake coil 32 via finish-finish connections 60 and 62, respectively. The ends of the outermost A and C turns of pancake coil 34 are connected to the ends of the outermost A and C turns in the next adjacent pancake coil via finish-finish connections 64 and 66, respectively, to start the next basic pair in the manner hereinbefore described relative to the first basic pair 40.

When the B and D circuits in pancake coil 32 leave pancake coil 32 at the ends of their innermost turns, i.e., the conductor turns referenced B5 and D5 in FIG. 3, a short circumferential distance is reserved for the positioning of the physical penetration of the B and D circuits in pancake coil 32. This arrangement is indicated in FIG. 3 by placing turn B0 adjacent to turn B5 and turn D0 adjacent to turn D5. The next adjacent conductor turns are shown radially spaced from the side-by-side turn indications, in order to more clearly illustrate the various start-start connections. In actual practice, there is no such radial spacing between the turns. The turns are all wound tightly together to minimize the radial build dimension, and to assure a mechanically strong structure.

The B and D circuits leave the ends of the innermost turns of the B and D circuits of pancake coil 32 and physically enter pancake coil 34 via start-start connections 68 and 70, respectively, entering spaces purposely left adjacent to the starts of the innermost turns of the D and B circuits. The B and D circuits then leave pancake coil 34 via the turns referenced B5 and D5 to physically enter the next adjacent pancake coil via start-start connections 72 and 74, respectively. This completes the description of the basic pair 40. The remaining basic pairs of winding 16 are interconnected in the same manner as basic pair 40, with the same reference numerals, except for a prime mark, being used to identify the various start-start and finish-finish connections of the last basic pair 42 in the axial stack of pancake coils.

The pancake coils may be wound from four reels of conductor, unlike certain prior art four strand arrangements, which require eight. Further, all intercoil connections are made as start-start or finish-finish connections between immediately adjacent pancake coils.

I claim as my invention:

1. An interleaved turn winding assembly for electrical inductive apparatus, comprising:

a plurality of axially spaced pancake coils, each having a plurality of insulated conductor turns defining first, second, third and fourth electrical paths therethrough, and means interconnecting said plurality of pancake coils such that said first, second, third and fourth electrical paths are continued from coil to coil, with said interconnecting means defining an interleaving pattern, which mutually interleaves the turns of the first, second, third and fourth electrical paths wherein physically adjacent turns are from different electrical paths, and from electrically different portions of the winding assembly, said interleaving pattern connecting the pancake coils in basic pairs, wherein the interleaving pattern is completed over two adjacent pancake coils, and then repeated in succeeding basic pairs, each of said first, second, third and fourth electrical paths having N conductor turns in one pancake coil of a basic pair, and N+1 turns in the other, with the additional turns from two of the paths being in one pancake coil, and the additional turns from the remaining two paths being in the other pancake coil, such that each pancake coil has the same total number of conductor turns, to provide an average of $N+\frac{1}{2}$ conductor turns in each electrical path, in each pancake coil.

2. The winding assembly of claim 1 including means interconnecting the first, second, third and fourth electrical paths at points adjacent to the pancake coils which define the axial ends of the axially spaced pancake coils, to provide first, second, third and fourth parallel paths through the winding assembly.

3. The winding assembly of claim 1 wherein the pancake coils of a basic pair have adjacent sides and non-adjacent sides, with a selected two of the electrical paths entering a first one of the pancake coils of a basic pair from its non-adjacent side, at the ends of selected outermost conductor turns, and with the remaining two of the electrical paths temporarily entering said first one of the pancake coils from its non-adjacent side, adjacent to selected innermost turns thereof, and then leaving said first one of the pancake coils to enter the remaining one of the pancake coils, from its adjacent side, at the ends of selected innermost conductor turns thereof.

4. The winding assembly of claim 3 wherein one of the selected two of the electric paths which enter the outermost turns of the first one of the pancake coils of a basic pair, and one of the remaining two electrical paths, have N+1 conductor turns in the first one of the pancake coils, and N conductor turns in the second one, and the remaining two electrical paths have N conductor turns in the first one of the pancake coils, and N+1 conductor turns in the second one.

* * * * *